US005606405A

United States Patent [19]

Yukinaga

[11] Patent Number: 5,606,405

[45] Date of Patent: Feb. 25, 1997

[54] DEVELOPING APPARATUS AND IMAGE FORMING APPARATUS HAVING DEVELOPING APPARATUS

[75] Inventor: Koji Yukinaga, Kawasaki, Japan

[73] Assignee: Kabushiki Kaisha Toshiba, Kawasaki, Japan

[21] Appl. No.: 558,648

[22] Filed: Nov. 16, 1995

[30] Foreign Application Priority Data

Nov. 21, 1994 [JP] Japan ..... 6-286521

[51] Int. Cl.[6] ..... G03G 15/06

[52] U.S. Cl. ..... 399/120; 222/DIG. 1

[58] Field of Search ..... 355/245, 246, 355/260, 251, 215, 259; 222/DIG. 1

[56] References Cited

U.S. PATENT DOCUMENTS

| | | | |
|---|---|---|---|
| 4,607,938 | 8/1986 | Hosoi et al. | 355/251 X |
| 4,931,838 | 6/1990 | Ban | 355/260 |
| 4,974,023 | 11/1990 | Aimoto et al. | 355/260 X |
| 4,998,140 | 3/1991 | Satou et al. | 355/245 |
| 5,148,223 | 9/1992 | Cipolla | 355/260 |
| 5,150,807 | 9/1992 | Seyfried et al. | 355/215 X |
| 5,296,902 | 3/1994 | Michlin | 355/260 |

FOREIGN PATENT DOCUMENTS 2-148071 6/1990 Japan .

*Primary Examiner*—Shuk Yin Lee
*Attorney, Agent, or Firm*—Foley & Lardner

[57] ABSTRACT

An image forming apparatus includes an apparatus body having a photosensitive drum for carrying an image, a developing unit, provided within the apparatus body, including a developing agent storage unit for storing a developing agent and a developing roller for supplying the developing agent in the developing agent storage unit to the photosensitive drum, a driving gear, provided detachably to the developing roller of the developing unit, for driving the developing roller when the driving gear is connected to the developing roller, and a rigid shield member, attached removably in the developing unit, for separating the developing agent storage unit from the developing roller in the developing unit and separating the developing roller from the driving gear when the shield member is attached, and for making the developing agent storage unit communicate with the developing roller and connecting the developing roller and the driving gear when the shield member is removed.

7 Claims, 5 Drawing Sheets

DEVELOPING APPARATUS AND IMAGE FORMING APPARATUS HAVING DEVELOPING APPARATUS

BACKGROUND OF THE INVENTION

1. Field of the Invention

The present invention relates to an image forming apparatus for use as, for example, an electronic copying machine.

2. Description of the Related Art

An electronic copying machine, when purchased by a user, is transported to the user. The electronic copying machine transported to the user includes a developing apparatus. Recently, such a developing apparatus contains a developing agent in advance for quick use.

The developing apparatus comprises a developing roller and a developing agent container for containing a developing agent. A film-like shield member with a high sealing effect is interposed between the developing roller and the developing agent container.

This type of developing apparatus containing a developing agent in advance has a small size in general. The user takes out the shield member from the developing apparatus by himself. Once the shield member is taken out, the developing roller is put in contact with the developing agent container so that the developing agent may be supplied.

In the prior art, however, if a copy button is erroneously depressed in the state in which the shield member is attached in the developing apparatus, the image forming operation begins.

Thus, if the user forgets to take out the shield member, or if the shield member is cut while it is being taken out, or if the copy button is erroneously depressed while the action of taking out the shield member is suspended, the image forming operation is performed uselessly and uneconomically.

SUMMARY OF THE INVENTION

The object of the present invention is to provide an image forming apparatus in which a developing apparatus is prohibited from operating when the user forgets to remove a partition member or the partition member has not been completely been removed.

According to the present invention, there is provided a developing apparatus comprising:

means for storing a developing agent, means for supplying the developing agent in the developing agent storage unit; and means for separating the supplying means from the storing means, wherein the separating means has a rigid member drawing or inserting to a position between the storing means and the supplying means.

Additional objects and advantages of the invention will be set forth in the description which follows, and in part will be clear from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

An embodiment of the present invention will now be described with reference to FIGS. 1 to 10B.

Figure 1:
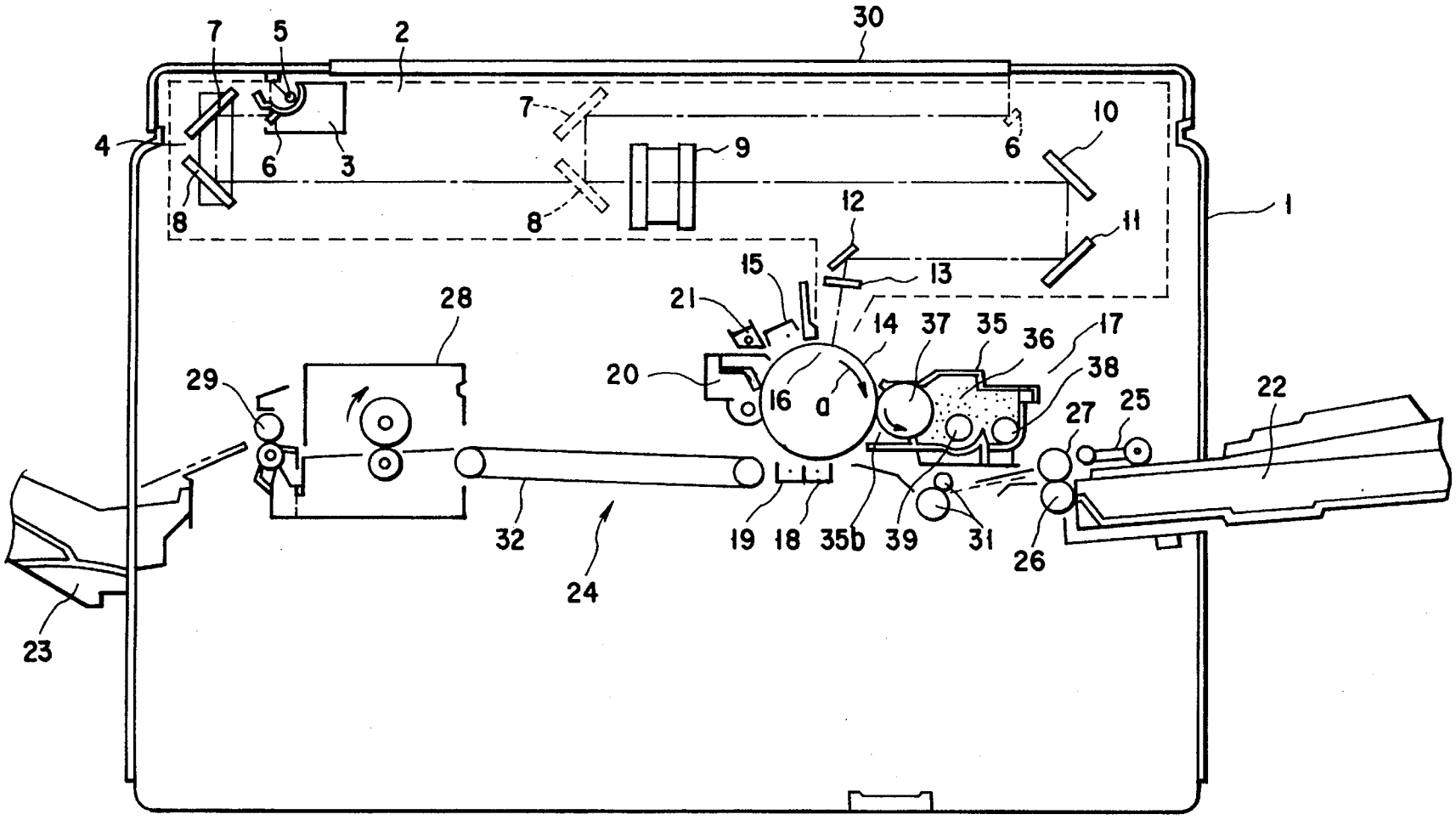
FIG. 1 shows the structure of an electronic copying machine according to an embodiment of the present invention.

FIG. 1 shows an electronic copying machine. Reference numeral 1 denotes an apparatus body. An exposing device 2 is provided in an upper part of the apparatus body 1. The exposing device 2 comprises first and second carriages 3 and 4. The first carriage 3 includes an exposure lamp 5 and a first reflection mirror 6. The second carriage 4 includes second and third reflection mirrors 7 and 8. An optical lens 9 is provided in an optical path of light reflected by the third reflection mirror 8. Fourth to sixth reflection mirrors 10, 11 and 12 and a slit glass 13 are arranged on the light emission side of the optical lens 9.

A photosensitive drum 14 functioning as an image carrying body is provided at a substantially central region of the apparatus body 1 such that the drum 14 can rotate in the direction of an arrow a. The photosensitive drum 14 is surrounded successively in the rotational direction thereof by a charger 15, an exposing unit 16, a developing apparatus 17, a transfer charger 18, a separation charger 19, a cleaning device 20 and a de-electrifier 21.

A sheet feed cassette 22 for feeding paper sheets is provided on one side of the apparatus body 1, and a sheet discharge tray 23 for receiving discharged sheets is provided on the other side thereof. The sheet feed cassette 22 and sheet discharge tray 23 are connected via a sheet convey path 24.

Along the sheet convey path 24, there are provided a pickup roller 25 for picking up a sheet from the sheet feed cassette 22, a feed roller 26, a separation roller 27, register rollers 31, the aforementioned transfer and separation chargers 18 and 19, a convey belt 32, a fixing device 28 and a sheet discharge roller 29.

An original table 30 on which an original document is placed is provided on top of the apparatus body 1. The first and second carriages 3 and 4 are run along the original table 30.

In an image forming mode, the exposure lamp 5 of the first carriage 3 is turned on and the first and second carriages 3 and 4 are run. Thereby, the original on the original table 30 is scanned by light, and reflection light from the original is reflected by the first to third reflection mirrors 6 to 8. The light then passes through the optical lens 9 and travels via the fourth to sixth reflection mirrors and slit glass 13. Thus, the light is radiated on the surface of the photosensitive drum 14. The surface of the drum 14 is charged by the charger 15. Since the light is radiated on the charged surface, an electrostatic latent image of the original is formed on the surface of the drum 14. The photosensitive drum 14 is rotated and the electrostatic latent image is moved to the developing apparatus 17. The latent image is made visible by the developing agent supplied from the developing apparatus 17.

At this time, on the other hand, a paper sheet is taken out from the sheet cassette by the rotation of the pickup roller 25. The paper sheet is fed by the rotation of the feed roller 26 and separation roller 27 on a one-by-one basis. The sheet is aligned by the register rollers 31 and fed to an image transfer unit between the photosensitive drum 14 and transfer charger 18. The visible image on the photosensitive drum is transferred onto the sheet by the function of the transfer charger 18.

The sheet onto which the visible image has been transferred is separated from the photosensitive drum 14 by the function of the separation charger 19. Then, the sheet is conveyed to the fixing device 28 by means of the convey belt 32 and the image is fixed. The sheet on which the image has been fixed is discharged to the discharge tray 23 by the discharge roller 29.

Figure 2:
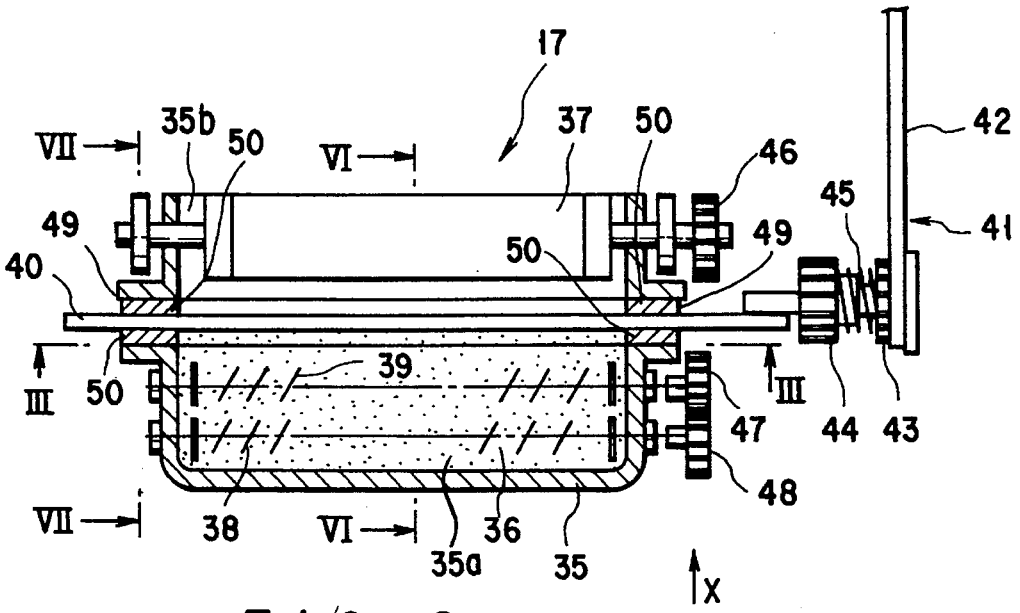
FIG. 2 is a partially cross-sectional plan view showing a developing apparatus.

FIG. 2 shows the developing apparatus 17 according to the present invention.

The developing apparatus 17 includes a developing container 35 with a front opening 35*b*. The developing container 35 includes a developing agent storage unit 35*a* for storing a developing agent 36. A developing roller 37 serving as developing agent supply means for supplying the developing agent 36 is rotatably provided within developing container 35. The developing roller 37 is situated to face the photosensitive drum 14. In addition, first and second mixers 38 and 39 for stirring and conveying the developing agent 36 are provided within the developing agent storage unit 35*a*. The developing agent 36 is stirred by the first and second mixers 38 and 39 and the toner concentration in the developing agent is stabilized. Then, the developing agent is supplied to the developing roller 37.

At the time of development, the developing agent 36 is stirred by the first mixer 38 and the toner concentration in the developing agent 36 is stabilized. Then, the developing agent 36 is moved to the second mixer 39 and fed to the developing roller 37 by the rotation of the second mixer 39. The developing agent 36 sent to the developing roller 37 is conveyed to the photosensitive drum 14 by the rotation of the developing roller 37. The developing agent 36 is supplied to a development region or a contact point between the photosensitive drum 14 and developing roller 37 and the development of the image is effected.

A shield plate 40 functioning as a rigid partition member with a thickness of about 1 mm is removably provided within the developing container 35. The shield plate 40 is able to draw or insert to a position between the developing roller 37 and the developing agent storage unit 35*a* of the developing container 35. The developing roller 37 is separated from the developing agent storage unit 35*a* by the shield plate 40.

The developing roller 37 and mixers 38 and 39 are rotated by driving means 41. The driving means 41 comprises a driving motor (not shown), a timing belt 42 run by the driving motor, and a gear 43 over which the timing belt 42 is passed. A shift gear (driving gear) 44 is attached to a rotational shaft of the gear 43 such that the shift gear 44 can movable along the rotational shaft of the gear 43. The shift gear 44 is urged away from the gear 43 by a coil spring 45 serving as an urging member. The rotational shafts of the developing roller 37 and mixers 38 and 39 are connected at one end to gears 46, 47 and 48, respectively. The shift gear 44 is detachably connected to the gears 46 and 47. The gears 47 and 48 of the mixers 38 and 39 are meshed with each other.

Both side walls of the developing container 35 are provided with insertion hole portions 49 functioning as attachment openings. The shield plate 40 is removably inserted through the insertion hole portions 49. Seal members 50 are interposed between the inner surfaces of the insertion hole portions 49 and both side surfaces of the shield plate 40. The seal members 50 are formed of a material with some degree of expandibility, such as foamed urethane, sponge or felt. The seal members 50 are opposed to each other to effect sealing. Thus, the gaps between the insertion hole portions 49 and shield plate 40 are sealed, and leaking of the developing agent 36 is prevented.

Figure 3:
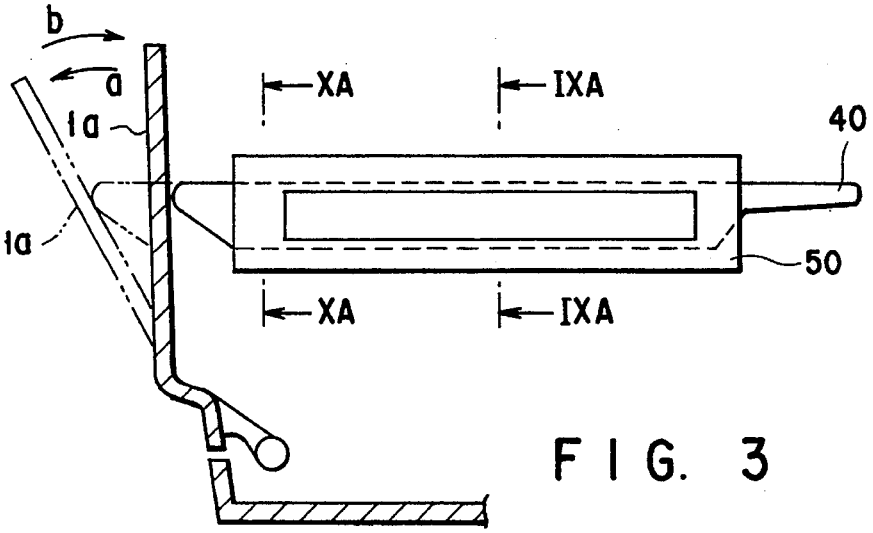
FIG. 3 is a cross-sectional view taken along line III—III in FIG. 2.

FIG. 3 is a cross-sectional view taken along line III—III in FIG. 2.

A front cover la serving as an opening/closing cover is openably provided on a front part of the apparatus body 1. A front end portion of the shield plate 40 is located close to the inner surface of the front cover 1*a*.

Figure 4:
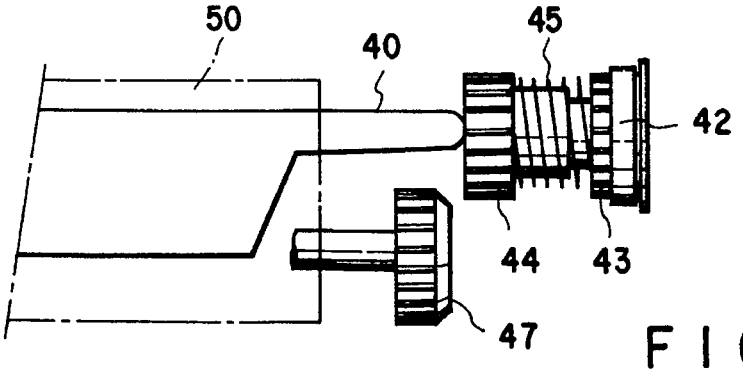
FIG. 4 shows a driving unit of the developing apparatus shown in FIG. 2.

FIG. 4 shows a driving force transmission system, as viewed in the direction of arrow X in FIG. 2.

In FIG. 4, the shield plate 40 is located in a predetermined shield position. A rear end portion of the shield plate 40 is put in contact with a side surface of the shift gear 44, and the shift gear 44 is pushed against the urging force of the coil spring 45. Thus, the shift gear 44 is separated from the gear 47 of the mixer 38 and the gear 46 of the developing roller 37. Accordingly, even if the driving force is transmitted from the gear 43 to the gear 44, it is not transmitted to the gear 47 or 46.

Figure 5:
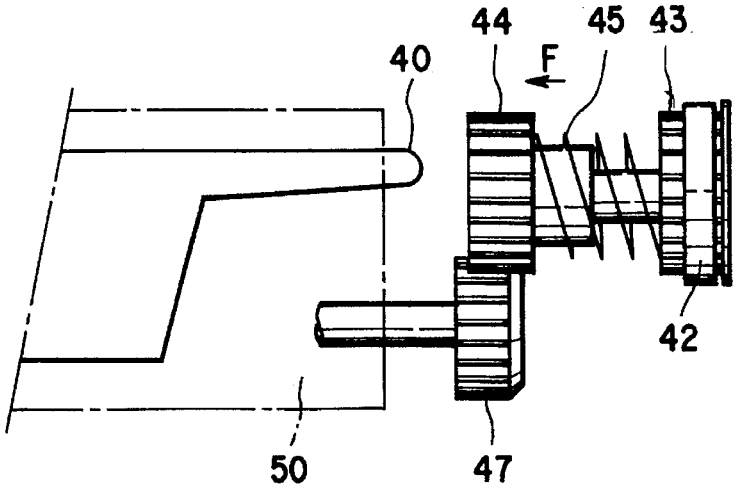
FIG. 5 shows a state in which the driving unit shown in FIG. 4 is connected to the developing apparatus.

FIG. 5 shows a state in which the shield plate 40 is withdrawn.

If the shield plate 40 is pulled out and the rear end portion of the shield plate 40 is separated from the shift gear 44, the shift gear 44 advances by the urging force of the coil spring 45 and engages the gears 47 and 46.

Figure 6:
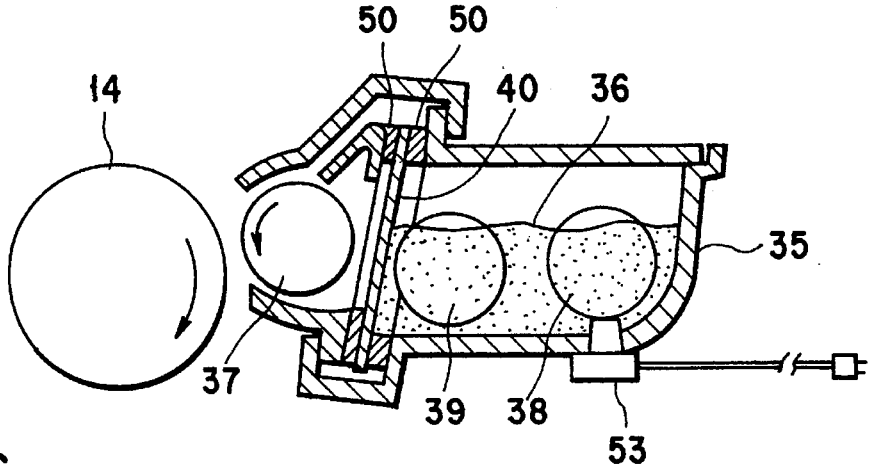
FIG. 6 is a cross-sectional view taken along line VI—VI in FIG. 2.

FIG. 6 is a cross-sectional view taken along line VI—VI in FIG. 2.

The flow of the developing agent 36 in a region between the developing roller 37 and mixers 38 and 39 is prevented by the shield plate 40. The copying machine is transported in this state.

An auto toner control sensor 53 is provided in an inside bottom portion of the developing container 35. The auto toner control sensor 53 is located below the mixer 38 and can detect a normal toner concentration in the developing agent while the mixer 38 is being rotated.

Figure 7:
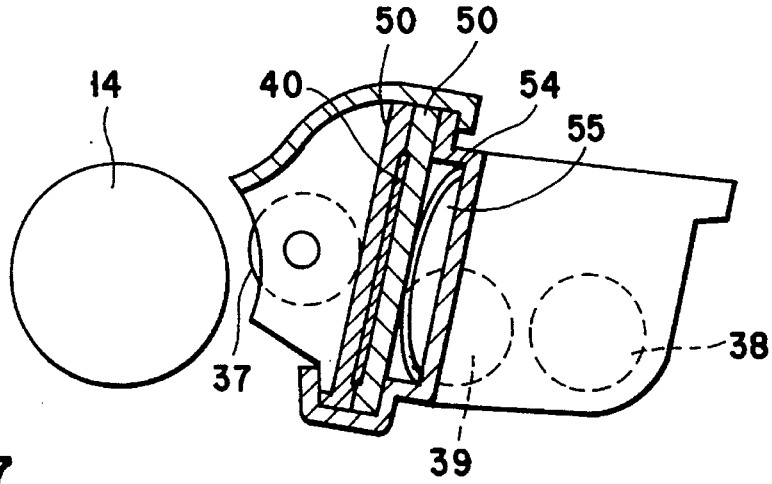
FIG. 7 is a cross-sectional view taken along line VII—VII in FIG. 2.

FIG. 7 is a cross-sectional view taken along line VII—VII in FIG. 2.

Storage units 55 are provided at both end portions of the developing container 35. The storage units 55 store pushing members 54 for pushing the seal members 50. The seal members 50 are put in close contact with the shield plate 40 by the pushing members 54.

Figure 8:
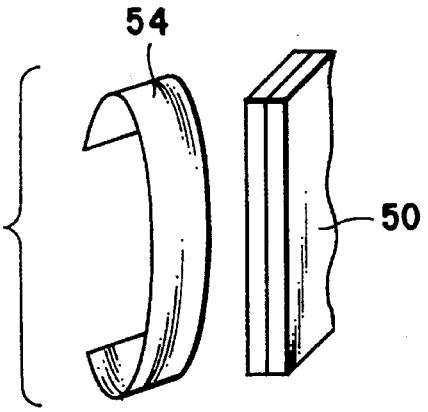
FIG. 8 is a perspective view showing a pushing member in the developing apparatus shown in FIG. 7.

FIG. 8 shows the pushing member 54 which is formed of a plate spring.

Figure 9A:
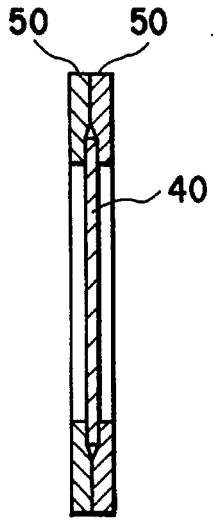
FIG. 9A shows a state in which a shield plate is provided in a seal member of the developing apparatus shown in FIG. 2.
Figure 10A:
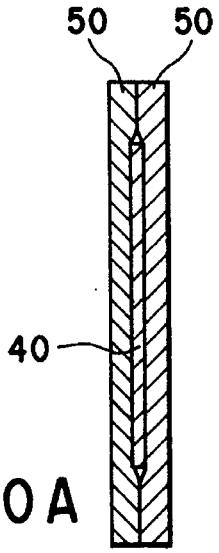
FIG. 10A shows a state in which a shield plate is provided in a seal member of the developing apparatus shown in FIG. 2.

FIG. 9A is a cross-sectional view taken along line IXA—IXA in FIG. 3, and FIG. 10A is a cross-sectional view taken along line XA—XA in FIG. 3.

Figure 9B:
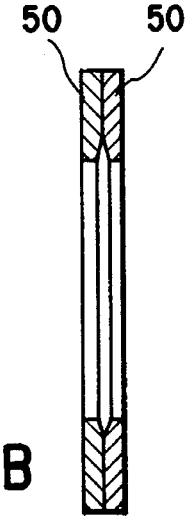
FIG. 9B shows a state in which the shield plate is removed from the seal member of the developing apparatus shown in FIG. 2.
Figure 10B:
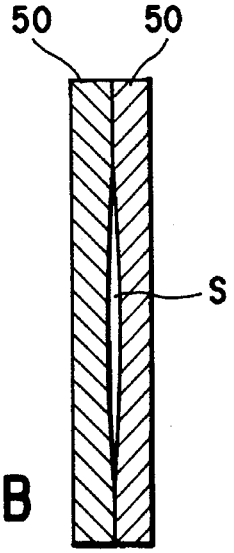
FIG. 10B shows a state in which the shield plate is removed from the seal member of the developing apparatus shown in FIG. 2.

In FIG. 9A, the upper end portions and lower end portions of the respective seal members 50 are put in contact with each other at all times. As shown in FIG. 9B, even if the shield plate 40 is removed, a sufficient sealing effect is obtained. In FIG. 10B, after the shield plate 40 is removed, a gap S occurs at a central region, although both end portions are put in contact. Thus, a leak of the developing agent may possibly occur in the longitudinal direction of the developing container 35.

However, the seal members 50 can be put in close contact with each other and the gap S can be eliminated by pushing the pushing both end portions of the seal members 50 by the pushing members 54. Thus, leaking of the developing agent 36 can be prevented.

Although the seal members 50 may deform due to long-time storage, such deformation is restricted by the pressing force of the pressuring members 54 and the occurrence of the gap S can be prevented.

When the electronic copying machine is transported to the user, the user opens the front cover 1*a*, as shown in FIG. 3, and pulls out the shield plate 40. Once the shield plate 40 is withdrawn, the developing agent 36 can be fed to the developing roller 37. In this case, as shown in FIG. 5, the shift gear 44 is released from the pushing force of the shield plate 40 and the shift gear 44 is moved in the direction of arrow F by the urging force of the coil spring 45. Thus, the shift gear 44 is engaged with the gear 47 of the mixer 38 and the gear 46 of the developing roller 37, thereby transmitting the driving force.

In the meantime, the user, in some cases, forgets to pull out the shield plate 40 at the time of setting up the apparatus, or suspends the pulling out of the shield plate 40.

Even if the user forgets to pull out the shield plate 40, the driving force is not transmitted to the gear 47 or 46 since the shift gear 44 is pushed by the rear end portion of the shield plate 40 and separated from the gears 47 and 46, as shown in FIG. 4. Accordingly, the developing roller 37 and mixers 38 and 38 do not rotate. That is, the auto toner sensor 53 cannot detect the toner concentration and senses abnormality. By the sensing of abnormality, the apparatus can immediately indicate to the user the failure to remove the shield plate 40 by a self-diagnosis function.

On the other hand, when the removal of the shield plate 40 is suspended, the front end portion of the shield plate 40 projects to the front side, as shown in FIG. 3. Thus, even if the user tries to close the front cover 1*a*, the front cover la abuts on the front end portion of the shield plate 40 and the front cover la cannot be completely closed. Accordingly, the user can surely recognize the suspension of the removal of the shield plate 40.

When it is possible that the shield plate 40 is potentially removable from the developing apparatus 17 due to vibration, etc. during transportation of the electronic copying machine, the shield plate 40 abuts on the opening/closing cover 1*a* and the movement of the shield plate 40 is limited. Thus, the removal of the shield plate 40 is prevented.

Furthermore, since the shield plate 40 is formed of a rigid member about 1 mm to 1.2 mm thick, the shield plate 40 is not cut while it is being pulled out. If the thickness of the shield plate 40 is 2 mm or more, toner may leak from a gap between the seal member 50 and shield plate 40. The material of the shield plate 40 should be at least non-magnetic and rigid, and should desirably be a metal such as SUS or a resin such as ABS. Therefore, the shield plate 40 can thus be surely removed.

Another embodiment of the present invention will now be described with reference to FIGS. 11 to 13.

Figure 11:
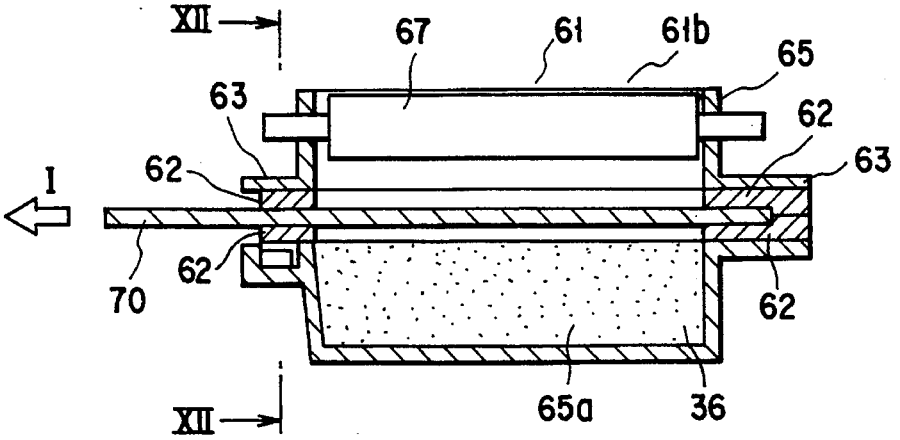
FIG. 11 is a partially cross-sectional plan view showing a developing apparatus according to another embodiment of the present invention.

FIG. 11 is a partially cross-sectional plan view showing a developing apparatus 61.

The developing apparatus 61 includes a developing container 65 with a front opening 61*a*. The developing container 65 includes a developing agent storage unit 65*a* for storing a developing agent 66. A developing roller 67 serving as developing agent supply means for supplying the developing agent 66 is rotatably provided within developing container 65.

Both side walls of the developing container 65 are provided with insertion hole portions 63 functioning as attachment openings. A shield plate 70 serving as a rigid partition member about 1 mm thick is removably inserted through the insertion hole portions 63. The developing roller 67 is separated from the developing agent storage unit 65*a* by the shield plate 70 within the developing container 65.

Seal members 62 are interposed between the insertion hole portions 63 of the developing container 65 and the shield plate 70.

Figure 12:
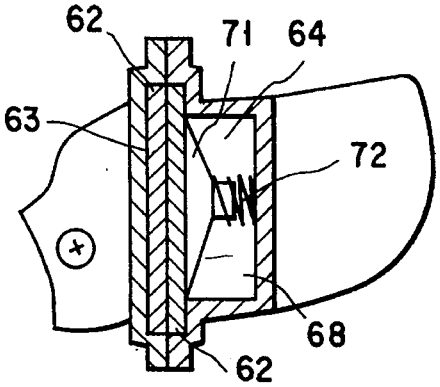
FIG. 12 is a cross-sectional view taken along line XII—XII in FIG. 11.

FIG. 12 shows storage units 68 provided at both end portions of the developing container 65.

The storage units 68 store pushing members 64 for pushing both end portions of the seal members 62.

Figure 13:
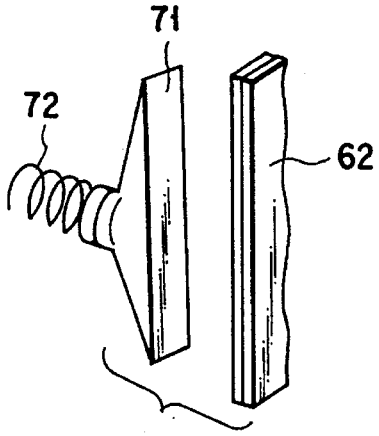
FIG. 13 is a perspective view showing a pushing member in the developing apparatus shown in FIG. 12.

FIG. 13 is a perspective view showing the pushing member 64.

The pushing member 64 comprises a pushing plate 71 and a spring 72 for urging the pushing plate 71.

The seal members 62 are pushed by the pushing plate 71 by the force of the spring 72. Thus, after the shield plate 70 is removed, the seal members 62 are put in close contact with each other and no gap occurs between the seal members 62.

Figure 14:
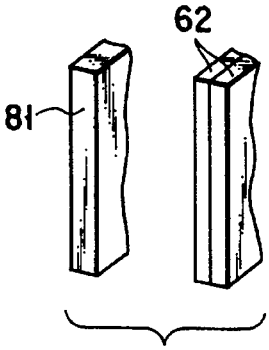
FIG. 14 is a perspective view showing another embodiment of the pushing member of the present invention.

FIG. 14 shows a pushing member 81 according to another embodiment of the invention.

The pushing member 81 is formed of foamed urethane and pushes both end portions of the seal members 62. After the shield plate 70 is removed, the seal members 62 are put in close contact with each other and no gap occurs between the seal members 62.

Figure 15:
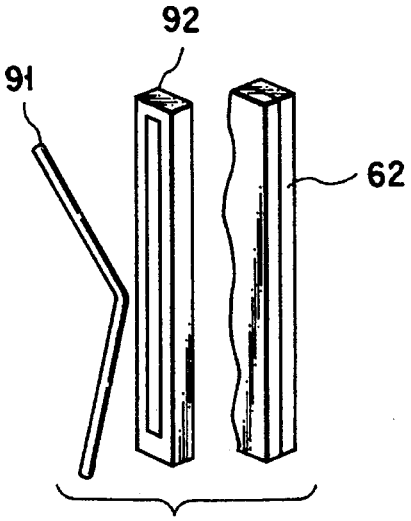
FIG. 15 is a perspective view showing still another embodiment of the pushing member of the present invention.

FIG. 15 shows a pushing member 91 according to still another embodiment of the invention.

The pushing member 91 is formed of a rod spring and pushes both end portions of the seal members 62 via a pushing casing 92. After the shield plate 70 is removed, the seal members 62 are put in close contact with each other and no gap occurs between the seal members 62.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A developing apparatus comprising:

a developing agent storage unit to store a developing agent;

developing agent supply means for supplying the developing agent in the developing agent storage unit;

driving means, provided detachably to the developing agent supply means, for driving said developing agent supply means when said driving means is connected to the developing agent supply means; and separating means for separating the developing agent supply means from the developing agent storage unit, wherein the separating means has a rigid partition member at a first position between the developing agent storage unit and the developing agent supply means, separates the developing agent supply means and the driving means when said partition member is at the first position, and connects the developing agent supply means and the driving means when said partition member is drawn from the first position.

2. A developing apparatus according to claim 1, wherein said driving means has a driving gear urged to connect to the developing agent supply means.

3. A developing apparatus according to claim 2, further comprising an urging member and wherein said separating means separates the driving gear from the developing agent supply means by moving the driving gear against an urging force of the urging member when said partition member is at said first position, and connects the driving gear of the driving means and the developing agent supply means by moving the driving gear by the urging force of the urging member.

4. A developing apparatus according to claim 1, further comprising:

a pair of seal members for sealing a gap corresponding to a position between the developing agent storage unit and the developing agent supply means.

5. An image forming apparatus comprising:

an apparatus body having an opening/closing cover at a side surface thereof and including an image carrying body for carrying an image;

developing means, provided within the apparatus body, including a developing agent storage unit for storing a developing agent and developing agent supply means for supplying the developing agent in the developing agent storage unit to said image carrying body;

driving means, provided detachably to the developing agent supply means of the developing means, for driving said developing agent supply means when said driving means is connected to the developing agent supply means; and separating means for separating the developing agent supply means from the developing agent storage unit, wherein the separating means has a rigid partition member at a first position between the developing agent storage unit and the developing agent supply means, separates the developing agent supply means from the driving means when said partition member is at the first position, and connects the developing agent supply means and the driving means when said partition member is drawn from the first position.

6. An image forming apparatus comprising:

an apparatus body having an image carrying body for carrying an image;

developing means, provided within the apparatus body, including a developing agent storage unit for storing a developing agent and developing agent supply means for supplying the developing agent in the developing agent storage unit to said image carrying body;

driving means, provided detachably to the developing agent supply means of the developing means, for driving said developing agent supply means when said driving means is connected to the developing agent supply means;

attachment opening portions provided in both side surface portions of the developing means;

separating means for separating the developing agent supply means from the developing agent storage unit, wherein the separating means has a rigid partition member at a first position between the developing agent storage unit and the developing agent supply means, separates the developing agent supply means from the driving means when said partition member is at the first position, and connects the developing agent supply means and the driving means when said partition member is drawn from the first position;

a pair of seal members for sealing gaps between said attachment opening portions and both surfaces of the partition member; and pushing means for pushing seal members to bring seal members into contact with each other.

7. The image forming apparatus according to claim 6, wherein said pushing means comprises a spring element.

* * * * *